US011240592B2

(12) United States Patent
Miki et al.

(10) Patent No.: US 11,240,592 B2
(45) Date of Patent: Feb. 1, 2022

(54) BASS REFLEX PORT AND ACOUSTIC DEVICE

(71) Applicant: YAMAHA CORPORATION, Hamamatsu (JP)

(72) Inventors: Akira Miki, Hamamatsu (JP); Hirofumi Onitsuka, Hamamatsu (JP); Katsuya Uchida, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 384 days.

(21) Appl. No.: 16/238,032

(22) Filed: Jan. 2, 2019

(65) Prior Publication Data

US 2019/0141437 A1 May 9, 2019

Related U.S. Application Data

(63) Continuation of application No. PCT/JP2017/023563, filed on Jun. 27, 2017.

(30) Foreign Application Priority Data

Jul. 7, 2016 (JP) ..... JP2016-134862

(51) Int. Cl.
*H04R 1/28* (2006.01)
*H04R 1/02* (2006.01)

(52) U.S. Cl.
CPC ..... *H04R 1/2819* (2013.01); *H04R 1/02* (2013.01); *H04R 1/025* (2013.01)

(58) Field of Classification Search
CPC ..... H04R 1/2819; H04R 1/02; H04R 1/025; H04R 1/2823; H04R 1/2826
See application file for complete search history.

(56) References Cited

U.S. PATENT DOCUMENTS 5,012,890 A 5/1991 Nagi et al.
5,109,422 A * 4/1992 Furukawa ..... H04R 1/023 181/160
6,019,188 A 2/2000 Nevill
6,275,597 B1 8/2001 Roozen
9,232,300 B2 1/2016 Miki
(Continued)

FOREIGN PATENT DOCUMENTS

CN 104053080 A 9/2014
CN 203978563 U 12/2014
(Continued)

OTHER PUBLICATIONS

Office Action issued in Japanese Appln. No. 2018-526309 dated Mar. 3, 2020. English machine translation provided.
(Continued)

*Primary Examiner* — Jason R Kurr
(74) *Attorney, Agent, or Firm* — Rossi, Kimms & McDowell LLP

(57) ABSTRACT

An acoustic device includes an enclosure and a bass reflex port that includes a tube body. An inner wall surface of the tube body includes multiple regions in which viscous resistances in a tube axis direction of moving air and the inner wall surface are different. The multiple regions are provided along a circumferential direction of the inner wall surface. The tube body is attached to an opening area in the enclosure.

20 Claims, 9 Drawing Sheets

(56) References Cited

U.S. PATENT DOCUMENTS

| | | | | |
|---|---|---|---|---|
| 2012/0247866 | A1* | 10/2012 | Lage | H04R 1/2826 181/196 |
| 2014/0093113 | A1 | 4/2014 | Dix | |
| 2014/0262598 | A1 | 9/2014 | Miki | |
| 2017/0195776 | A1* | 7/2017 | Reimert | H04R 1/2823 |

FOREIGN PATENT DOCUMENTS

| | | | |
|---|---|---|---|
| CN | 204131694 | U | 1/2015 |
| DE | 20309771 | U1 | 9/2003 |
| JP | H01241297 | A | 9/1989 |
| JP | H08140177 | A | 5/1996 |
| JP | 2000165974 | A | 6/2000 |
| JP | 2003061177 | A | 2/2003 |
| JP | 2008278129 | A | 11/2008 |
| JP | 2014179930 | A | 9/2014 |
| WO | 9962292 | A1 | 12/1999 |
| WO | 2012080879 | A1 | 6/2012 |

OTHER PUBLICATIONS

International Search Report issued in Intl. Appln. No. PCT/JP2017/023563 dated Aug. 8, 2017. English translation provided.

Written Opinion issued in Intl. Appln. No. PCT/JP2017/023563 dated Aug. 8, 2017.

Extended European Search Report issued in European Application No. 17824078.4 dated Jan. 31, 2020.

Office Action issued in Chinese Appln. No. 201780037241.5 dated Apr. 26, 2020. English translation provided.

English translation of Office Action issued in Chinese Appln. No. 201780037241.5 dated Aug. 2, 2019.

Office Action issued in European Appln. No. 17824078.4 dated Nov. 15, 2021.

* cited by examiner

BASS REFLEX PORT AND ACOUSTIC DEVICE

BACKGROUND

Technical Field

The present invention relates to a bass reflex port and an acoustic device such as a bass reflex speaker.

Background Art

A bass reflex speaker that enhances the volume of the low-pitch range using sound reflected from a speaker unit toward a rear surface has conventionally been proposed. With a bass reflex speaker, a bass reflex port that causes the interior and exterior of a housing (enclosure) to be in communication is installed. With a bass reflex speaker, abnormal sound (noise) caused by the bass reflex port is generated. In view of this, various techniques for reducing the abnormal sound from the bass reflex port have been proposed.

Patent Literature 1 discloses a bass reflex port with an inner wall surface on which multiple ribs are provided. With this bass reflex port, multiple ribs formed over the entire length of the bass reflex port are arranged in the circumferential direction of the bass reflex port such that the length direction of the ribs is the entire length direction of the bass reflex port. The heights of the ribs become lower toward an opening end, and the area of the region surrounded by the closed curve passing through the peak of each rib becomes larger toward the opening end. That is, the opening portion of the bass reflex port is flared. Ring-shaped wall portions that intersect the ribs and fill the gaps between the ribs are formed at positions slightly near the opening end with respect to the center of the bass reflex port. According to the technique disclosed in Patent Literature 1, the diameter (i.e., the inner diameter of the wall portion) of the approximately circular closed curve that passes through the peaks of the ribs can be considered an inner diameter equivalent to that of the bass reflex port in terms of a sound wave, and since the opening portion is flared, wind noise can be reduced.

Patent Literature 2 discloses a speaker system in which the entirety of an inner wall surface of a bass reflex port or the entirety of an inner wall surface of a partial segment in a tube axis direction of the bass reflex port is formed into recessed and protruding shapes. According to the technique disclosed in Patent Literature 2, compared to a speaker system including a conventional bass reflex port with a smooth inner wall surface, the viscous resistance of the inner wall surface of the bass reflex port decreases and the flow of air is smoother, and thus it is possible to reduce harmonic distortion caused by the flow of air.

CITATION LIST

Patent Literature

Patent Literature 1: JP 2003-061177A
Patent Literature 2: JP 8-140177A

SUMMARY

Technical Problem

However, even if the techniques disclosed in Patent Literatures 1 and 2 are used, abnormal sound that is generated from the bass reflex port due to air flowing in the bass reflex port cannot be sufficiently reduced.

The present invention was made in view of the foregoing circumstance, and aims to reduce abnormal sound generated due to air flowing in a bass reflex port.

Solution to Problem

The present invention provides a bass reflex port including a tube body. An inner wall surface of the tube body has a plurality of regions in which viscous resistances in a tube axis direction between moving air and the inner wall surface are different, and the plurality of regions are provided along a circumferential direction of the inner wall surface.

With the bass reflex port according to the present invention, multiple regions with different viscous resistances are provided in a circumferential direction of an inner wall surface, and therefore the viscous resistance in the tube axis direction of the moving air and the inner wall surface changes along the circumferential direction. With the present bass reflex port, the amount of movement of the air that passes through the inner wall surface of the tube body differs in the multiple regions, and therefore the positions and timings at which eddies occur differ in these regions. That is, in the present bass reflex port, the positions and timings at which eddies occur differ in the circumferential direction. In this manner, the positions and timings at which the eddies occur are dispersed without being concentrated in the circumferential direction, and therefore in the present bass reflex port, the eddies can be prevented from growing, and the abnormal noise generated due to the eddies can be reduced. That is, according to the acoustic device including the present bass reflex port, the abnormal noise that occurs due to the air flowing in the bass reflex port can be reduced.

With the techniques disclosed in Patent Literatures 1 and 2, the positions and timings at which the eddies occur are not dispersed in the circumferential direction. In contrast to this, with the present bass reflex port, the positions and timings at which the eddies occur are dispersed in the circumferential direction as described above, and thus it is possible to prevent the eddies from growing. For this reason, according to the present bass reflex port, compared to the bass reflex ports disclosed in Patent Literatures 1 and 2, abnormal sound that is generated from the bass reflex port due to air flowing in the bass reflex port can be sufficiently reduced.

In the above-described bass reflex port, the plurality of regions can include a plurality of regions formed of materials having different viscous resistances.

In the above-described bass reflex port, the plurality of regions can include at least one region in which at least one of a recess and a protrusion is provided.

In the above-described bass reflex port, the plurality of regions can include a plurality of regions in which the sizes of the recesses or protrusions or the number of the recesses or protrusions arranged per unit area are different.

In the above-described bass reflex ports, at least one of the plurality of regions can extend so as to intersect the tube axis direction.

In the above-described bass reflex ports, at least one of the plurality of regions can extend in a wave shape along the tube axis direction.

In the above-described bass reflex ports, at least one of the plurality of regions can extend such that its width in the circumferential direction changes along the tube axis direction.

In the above-described bass reflex ports, the plurality of regions can include a plurality of regions with different widths in the circumferential direction.

In the above-described bass reflex ports, the plurality of regions can include a plurality of regions in which at least one of the length in the tube axis direction and the length in the circumferential direction is different.

In the above-described bass reflex ports, the plurality of regions can include a plurality of regions formed such that the viscous resistances change gradually at boundaries.

An acoustic device according to the present invention includes: an enclosure provided with an opening; and any above-described bass reflex port, which is arranged in the enclosure. One end portion in an axial direction of the tube body of the bass reflex port is fixed to a circumferential edge of the opening.

DESCRIPTION OF EMBODIMENTS

Hereinafter, embodiments of the present invention will be described with reference to the drawings.

First Embodiment

Figure 1:
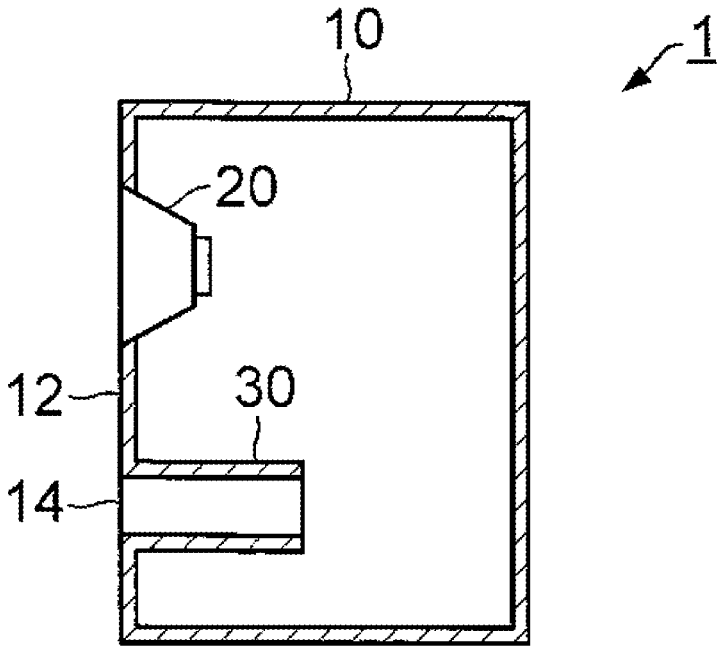
FIG. 1 is a cross-sectional view showing a configuration of an acoustic device 1 including a bass reflex port 30, which is a first embodiment of the present invention.

FIG. 1 is a cross-sectional view showing a configuration of an acoustic device 1 including a bass reflex port 30, which is a first embodiment of the present invention. The acoustic device 1 is a device that emits sound corresponding to an acoustic signal supplied from an external apparatus, and specifically is a bass reflex speaker. The acoustic device 1 includes an enclosure 10, which is the housing of the acoustic device 1, a speaker unit 20 composed of a vibration plate, a voice coil, and the like, and a bass reflex port 30.

The enclosure 10 is a hollow structural body (typically a cuboid) constituted by multiple plate materials. The speaker unit 20 is fixed to a plate material 12 among the multiple plate materials constituting the enclosure 10. The plate material 12 functions as a baffle surface. A circular opening 14 penetrating through the plate material 12 is provided in the plate material 12. The enclosure 10 of the present embodiment is constituted by multiple plate materials, but the enclosure 10 may be a molded resin product obtained through injection molding or the like. Also, in the present embodiment, the opening 14 is provided in the plate material (i.e., plate material 12) functioning as the baffle surface in the acoustic device 1, but the opening 14 may be provided in a surface other than the baffle surface, such as the rear surface or a side surface of the enclosure 10. Also, the shape of the opening 14 is not limited to being circular and may be another shape.

The bass reflex port 30 is constituted by a hollow, approximately circular cylinder-shaped tube member and is arranged in the enclosure 10. Openings are formed at both ends in the axial direction of the bass reflex port 30. One opening end of the bass reflex port 30 is fixed to the circumferential edge of the opening 14 of the plate material 12. The other opening end of the bass reflex port 30 is open in the enclosure 10. The space in the enclosure 10 and the space outside of the enclosure are connected via the bass reflex port 30 and the opening 14. For this reason, the air inside and outside of the enclosure 10 passes through the bass reflex port 30 in response to vibration of the vibration plate of the speaker unit 20.

Figure 2:
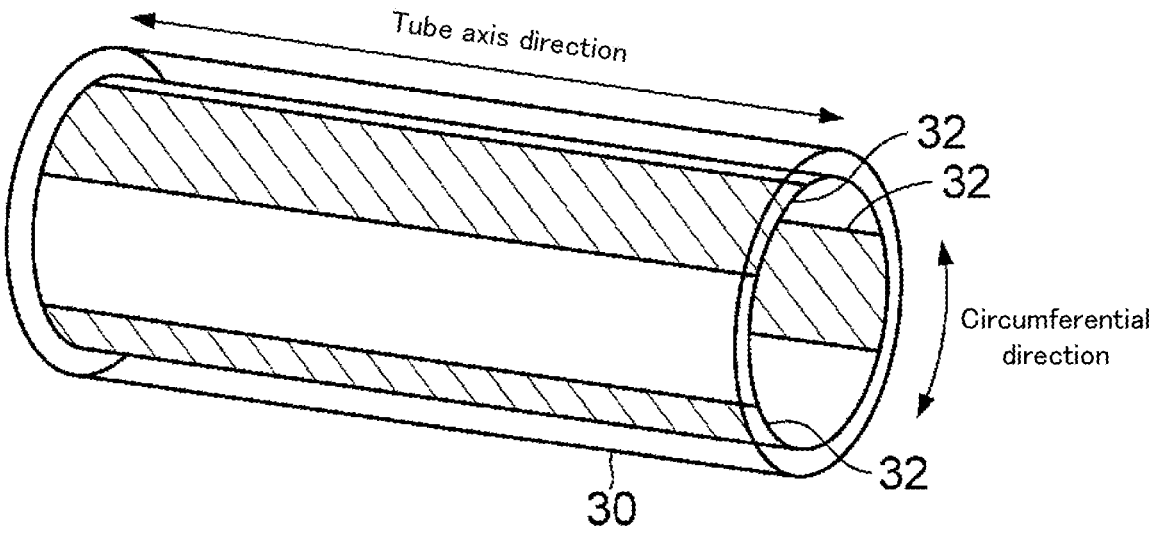
FIG. 2 is a transparent perspective view showing a configuration of the bass reflex port 30.
Figure 3:
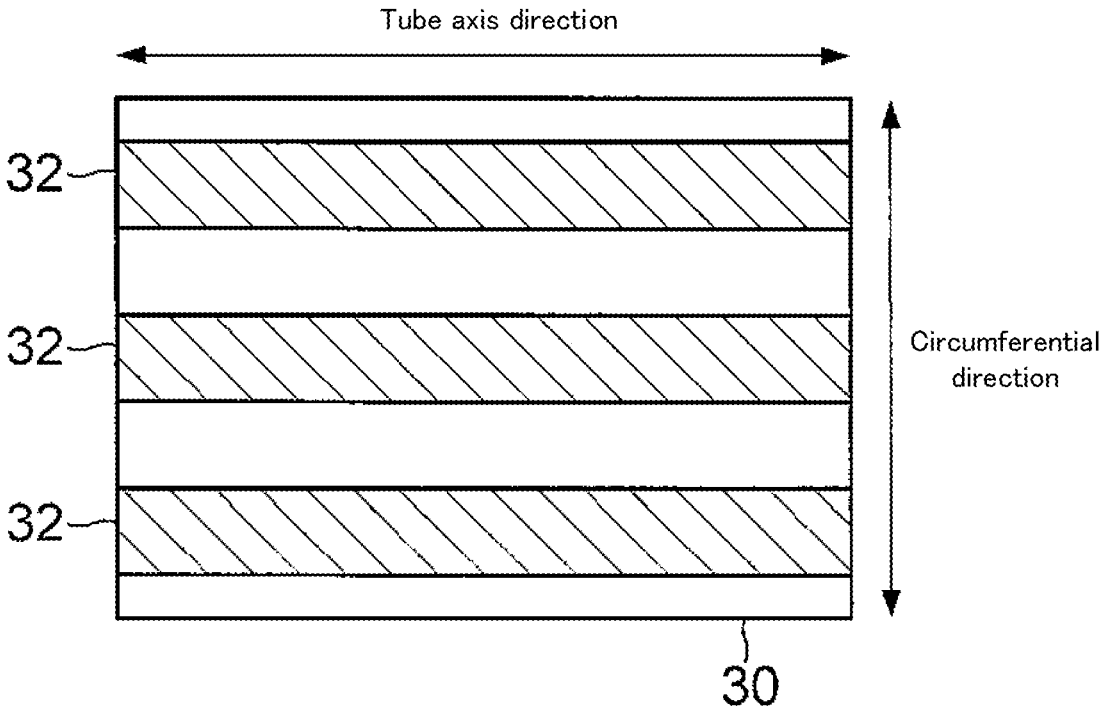
FIG. 3 is a development view in which the bass reflex port 30 is opened by cutting a wall surface of the bass reflex port 30 in a tube axis direction.

FIG. 2 is a transparent perspective view showing a configuration of the bass reflex port 30. The bass reflex port 30 is a circular cylinder-shaped (hereinafter called a straight tube shape) tubular member in which the inner diameter and the outer diameter are kept approximately constant from one end to another end of the bass reflex port 30. In the present specification, a line at the center of the tube in the bass reflex port 30 is called a tube axis. FIG. 3 is a development view in which the bass reflex port 30 is opened by cutting a wall surface of the bass reflex port 30 in a tube axis direction. FIG. 3 shows an inner wall surface side of the bass reflex port 30.

Sheet-like members 32 that extend from one end to another end of the bass reflex port 30 are fixed to portions in the circumferential direction of the inner wall surface of the bass reflex port 30. In other words, with the bass reflex port 30, regions provided with the sheet-like members 32 and regions not provided with the sheet-like members 32 are alternatingly repeated on the inner wall surface in the circumferential direction of the bass reflex port 30. Hereinafter, regions provided with the sheet-like members 32 will be called first regions, and regions not provided with the sheet-like members 32 will be called second regions. In FIGS. 2 and 3, the sheet-like members 32 are emphasized with oblique hatching. In the examples shown in FIGS. 2 and 3, three sheet-like members 32 are provided in a dispersed manner at 120-degree intervals in a circumferential direction of the bass reflex port 30. The length (width) of each sheet-like member 32 in the circumferential direction of the bass reflex port 30 is a length obtained by dividing the inner circumference of the bass reflex port 30 into six equal portions. That is, with the bass reflex port 30 of the examples shown in FIGS. 2 and 3, the first regions and the second regions are repeated every 60 degrees in the circumferential direction of the bass reflex port 30.

The wall surface of the bass reflex port 30 is constituted by synthetic resin or the like, for example. As described above, with the bass reflex port 30, the sheet-like member 32 is provided not on the entirety of the inner wall surface of the bass reflex port 30, but on portions in the circumferential direction of the inner wall surface. For this reason, the second regions, which are not provided with the sheet-like members 32, are regions in which portions of the wall surface made of synthetic resin or the like of the bass reflex port 30 are exposed.

The first regions, which are provided with the sheet-like members 32, are regions in which the viscous resistance in the tube axis direction of the moving air and the inner wall surface (hereinafter simply referred to as the viscous resistance in the tube axis direction in some cases) is different from that of the second regions (specifically, the regions in which portions of the wall surface made of synthetic resin or the like are exposed). The viscous resistance in the tube axis direction of the present embodiment functions so as to hinder movement of air by acting between the air moving in the tube axis direction and the inner wall surface of the bass reflex port 30. For this reason, the viscous resistance in the tube axis direction can be expressed as the dynamic frictional resistance in the tube axis direction between the air and the inner wall surface or the amount by which the movement of the air in the tube axis direction is hindered.

The sheet-like members 32 are constituted by a material with a larger viscous resistance in the tube axis direction than the material (e.g., synthetic resin) constituting the wall surface of the bass reflex port 30. For example, the sheet-like members 32 are constituted by felt. That is, the first regions are constituted by a material with a larger viscous resistance in the tube axis direction than the material constituting the second regions.

The configuration of the acoustic device 1 including the bass reflex port 30 has been described above.

Figure 4:
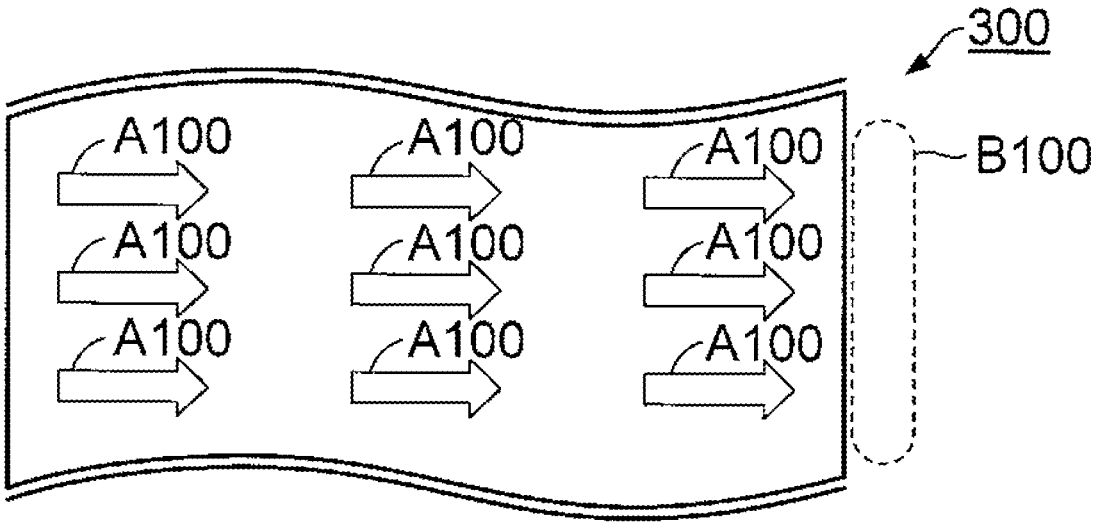
FIG. 4 is a development view showing a manner in which air passes over the inner wall surface of a bass reflex port 300, which is a comparative example of the embodiment.

Next, the effect of the bass reflex port 30 of the present embodiment will be described with reference to a comparative example. FIG. 4 is a development view showing a manner in which air passes over the inner wall surface of the bass reflex port 300, which is a comparative example of the present embodiment. In FIG. 4, the manner in which air passes over the inner wall surface of the bass reflex port 300 according to the comparative example is indicated by the arrows A100. The wall surface of the bass reflex port 300 is constituted by synthetic resin or the like and the viscous resistance is constant over the entire inner wall surface.

With the bass reflex port 300 in the comparative example, the viscous resistance that acts between the air passing over the inner wall surface and the inner wall surface is uniform over the entirety of the inner wall surface. Accordingly, the air that has entered the bass reflex port 300 reaches the area B100 near the exit side end at almost the same timing at each position in the circumferential direction. For this reason, with the bass reflex port 300, the timings at which the air separates from the inner wall surface are the same in the circumferential direction, and the positions in the tube axis direction at which the air separates from the inner wall surface are the same in the circumferential direction. That is, in this bass reflex port 300, the positions and timings at which eddies occur due to the air separating from the inner wall surface coincide in the circumferential direction. For this reason, with this bass reflex port 300, the eddies that occur grow into eddies with strong turbulence. As a result, with this bass reflex port 300, abnormal sound with a large noise level is generated. Although the bass reflex port 300 of a comparative example has been described above, the bass reflex ports of Patent Literatures 1 and 2 essentially act similarly to the bass reflex port 300.

Figure 5:
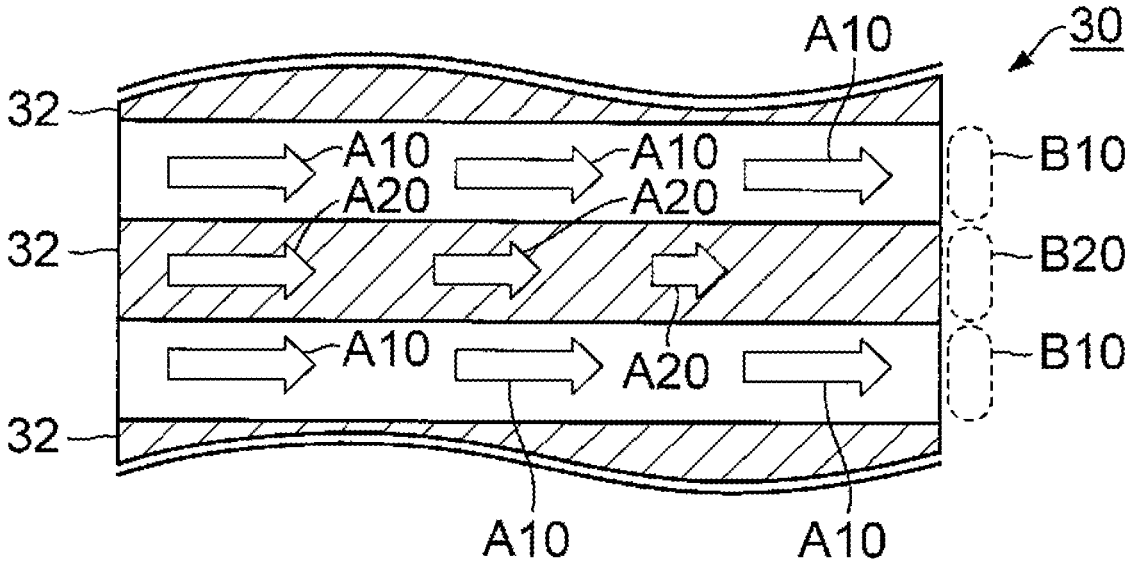
FIG. 5 is a development view showing a manner in which air passes over the inner wall surface of the bass reflex port 30.

Next, the action of the bass reflex port 30 of the present embodiment will be described with reference to a comparative example. FIG. 5 is a development view showing a manner in which air passes over the inner wall surface of the bass reflex port 30 of the present embodiment. In FIG. 5, the manner of the air passing over the first regions provided with the sheet-like members 32 is indicated by arrows A20, and the manner of the air passing over the second regions not provided with the sheet-like members 32 is indicated by arrows A10.

With the bass reflex port 30 of the present embodiment, the viscous resistance in the tube axis direction of the first regions is larger than the viscous resistance in the tube axis direction of the second regions, and therefore the amount of movement of the air passing over the first regions and the amount of movement of the air passing over the second regions are different. Specifically, the air passing over the second regions on the inner wall surface of the bass reflex port 30 passes over relatively smoothly, similarly to the bass reflex port 300 of the comparative example. On the other hand, the first regions are influenced by the viscous resistances of the sheet-like members 32, and thus the flow rate of the air passing over the first region decreases as it progresses over the first region, compared to the air passing over the second region. Accordingly, with the bass reflex port 30, after the air passing over the second region reaches the area B10 near the exit side end, the air passing over the first region reaches the area B20 near the exit side end. For this reason, with the bass reflex port 30, the timing at which the eddies occur due to the air separating from the inner wall surface in the first regions is earlier compared to the timing at which the eddies occur due to the air separating from the inner wall surface in the second regions. Also, in the second regions, eddies occur due to the air separating from the inner wall surface at a position relatively near the exit side end in the tube axis direction compared to the first regions. On the other hand, in the first regions, the eddies occur due to the air separating from the inner wall surface at a position relatively near the center in the tube axis direction compared to the second region. That is, in the bass reflex port 30 of the present embodiment, the positions and timings at which eddies occur due to the air separating from the inner wall surface differ in the circumferential direction.

With the bass reflex port 30 of the present embodiment, it is possible to prevent the eddies from growing since the positions and timings at which the eddies are generated are dispersed without being concentrated in the circumferential direction. For this reason, the noise level of the abnormal sound caused by the eddies is reduced. That is, according to the acoustic device 1 including the bass reflex port 30, abnormal sound caused by air flowing in the bass reflex port 1 can be reduced.

Also, with the bass reflex port 30, the positions and timings at which the eddies occur differing in the circumferential direction, and therefore the phase of the turbulence of the flow of the air shifts in the circumferential direction, whereby eddies of various phases overlap and cancel out each other. From this respect as well, with the bass reflex port 30, it is possible to prevent the eddies from growing, and it is possible to reduce abnormal noise that occurs due to the eddies.

Also, with the bass reflex port 30, the sheet-like members 32 are spread from one end to the other end of the bass reflex port 30. For this reason, with the bass reflex port 30, the movement of air in the tube axis direction can be sufficiently hindered by the sheet-like members 32.

With the bass reflex port 30 of the examples shown in FIGS. 2 and 3, three sheet-like members 32 are provided in a dispersed manner at 120-degree intervals in the circumferential direction of the bass reflex port 30. However, with the bass reflex port 30, the sheet-like members 32 need only be arranged in a dispersed manner in the circumferential direction, the number of sheet-like members 32 is not limited to three, and the intervals of the sheet-like members 32 are not limited to 120-degree intervals.

Second Embodiment

Figure 6:
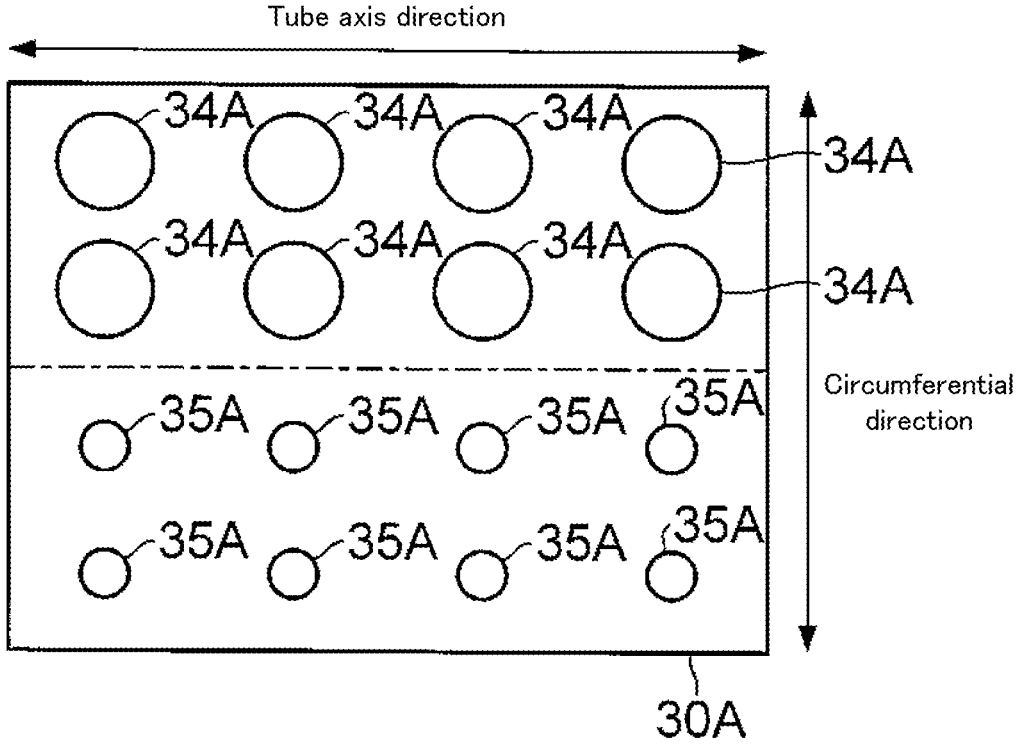
FIG. 6 is a development view showing a configuration of a bass reflex port 30A, which is a second embodiment of the present invention.

FIG. 6 is a development view in which a bass reflex port 30A, which is a second embodiment of the present invention, is opened by cutting the wall surface of the bass reflex port 30A in the tube axis direction. The bass reflex port 30A of the present embodiment is attached to an acoustic device, similarly to the bass reflex port 30 of the first embodiment.

The bass reflex port 30A differs from the bass reflex port 30 of the first embodiment in that it includes multiple recessed portions 34A and multiple recessed portions 35A instead of the sheet-like members 32. The recessed portions 34A and 35A are round recesses provided on the inner wall surface of the bass reflex port 30. The sizes (specifically, the diameters and depths) of the recessed portions 34A are larger than the sizes of the recessed portions 35A.

With the bass reflex port 30A, the multiple recessed portions 34A are provided on a portion in the circumferential direction of the inner wall surface, and the multiple recessed portions 35A are provided on another portion in the circumferential direction of the inner wall surface. The multiple recessed portions 34A are aligned in the tube axis direction approximately from one end to the other end of the bass reflex port 30. In the example shown in FIG. 6, the multiple recessed portions 34A are aligned in the form of a matrix with two rows in the circumferential direction and four columns in the tube axis direction. The multiple recessed portions 35A are also similar to the multiple recessed portions 34A.

Hereinafter, a region provided with the recessed portions 34A (in the example shown in FIG. 6, the region in which the multiple recessed portions 34A are arranged in the form of a matrix with two rows and four columns) will be referred to as a first region, and a region provided with the recessed portions 35A (in the example shown in FIG. 6, the region in which the multiple recessed portions 35A are arranged in the form of a matrix with two rows and four columns) will be referred to as a second region. With the bass reflex port 30A, the first region and the second region are arranged alternatingly in the circumferential direction. The viscous resistance in the tube axis direction of the first region and the viscous resistance in the tube axis direction of the second region are smaller than the viscous resistance in the tube axis direction of a smooth surface (a surface in a case where it is assumed that there are no recessed portions 34A and 35A) such as the inner wall surface of the conventional bass reflex port. Also, the viscous resistance in the tube axis direction of the second region is smaller than the viscous resistance in the tube axis direction of the first region.

Figure 7:
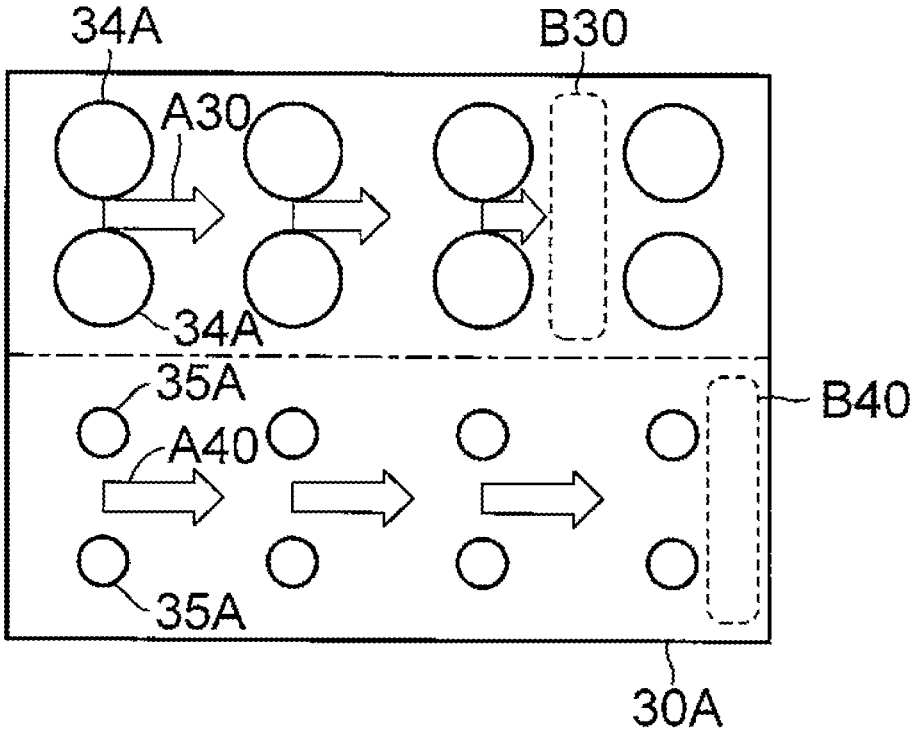
FIG. 7 is a development view showing a manner in which air passes over the inner wall surface of the bass reflex port 30A.

FIG. 7 is a development view showing a manner in which air passes over the inner wall surface of the bass reflex port 30A. In FIG. 7, the manner of the air passing over the first region provided with the recessed portions 34A is indicated by arrows A30, and the manner of the air passing over the second region provided with the recessed portions 35A is indicated by arrows A40.

The air passing through the first region is influenced by the recessed portions 34A and separates from the inner wall surface in the area B30 near the center of the end portion on the exit side. On the other hand, the air passing through the second region is influenced by the recessed portions 35A and separates from the inner wall surface in the area B40 near the exit of the end portion on the exit side. That is, the positions and timings at which eddies occur due to the air separating from the inner wall surface differ in the first regions and the second regions.

As described above, with the bass reflex port 30A, the first regions and the second regions, which have different viscous resistances in the tube axis direction between the moving air and the inner wall surface, are arranged alternatingly in the circumferential direction of the inner wall surface. For this reason, with the bass reflex port 30A of the present embodiment as well, the positions and timings at which eddies occur differ in the circumferential direction, similarly to the bass reflex port 30 of the first embodiment. Accordingly, in the present embodiment as well, an effect similar to that of the first embodiment is obtained.

With the bass reflex port 30A of the present embodiment, two types of regions with different viscous resistances in the tube axis direction (the first region with the recessed portions 34A and the second region with the recessed portions 35A) are arranged in the circumferential direction of the inner wall surface. However, the types of the viscous resistance regions arranged in the circumferential direction are not limited to two types, and may be three or more types. That is, it is also possible to further provide a region provided with recessed portions of a different size from those of the first region and the second region.

In the bass reflex port 30A, the number of recessed portions 34A in the first region and the number of recessed portions 35A in the second region are not limited to the number illustrated in FIG. 6.

With the bass reflex port 30A of the present embodiment, the recessed portions 34A and 35A were provided in the first region and the second region respectively. However, in the bass reflex port 30A, protruding portions with diameters that are about the same as the diameters of the recessed portions 34A and 35A may be provided at the positions at which the recessed portions 34A and 35A were provided, instead of the recessed portions 34A and 35A. In this mode as well, the influence of the large protruding portions in the tube axis direction and the influence of the small protruding portions in the tube axis direction are different, and therefore the positions and timings at which the eddies are generated due to the air being separated from the inner wall surface differ in the circumferential direction. Accordingly, in this mode as well, an effect similar to that of the present embodiment is obtained. Also, in the bass reflex port 30A, the region in which the recessed portions are aligned in the tube axis direction and the region in which the protruding portions are aligned in the tube axis direction may both be included. Also, in the bass reflex port 30A, the recessed portions 34A and 35A were aligned methodically in the form of a matrix. However, the recessed portions 34A and 35A need not be arranged in the form of a matrix and may be aligned randomly. This also applies to the case of the protruding portions. That is, it is sufficient that at least a portion of the regions provided in the circumferential direction of the inner wall surface of the bass reflex port are regions in which at least one of the recessed portions and the protruding portions are provided.

With the bass reflex port 30A of the present embodiment, the viscous resistances in the tube axis direction were changed in the circumferential direction by changing the sizes of the recessed portions 34A and the sizes of the recessed portions 35A. However, in the bass reflex port 30A, the number of protruding portions arranged per unit area may be changed in the circumferential direction such that, for example, the number of recessed portions (i.e., the concentration of recessed portions) arranged per unit area of the first region and the number of recessed portions arranged per unit area of the second region are different. In this case, the sizes of the recessed portions in the first regions and the sizes of the recessed portions in the second regions may be the same. Also, the number of protruding portions (i.e., the concentration of protruding portions) arranged per unit area may be changed in the circumferential direction in a manner similar to that of the above-described concentration of recessed portions. In these modes as well, an effect similar to that of the present embodiment is obtained.

Third Embodiment

Figure 8:
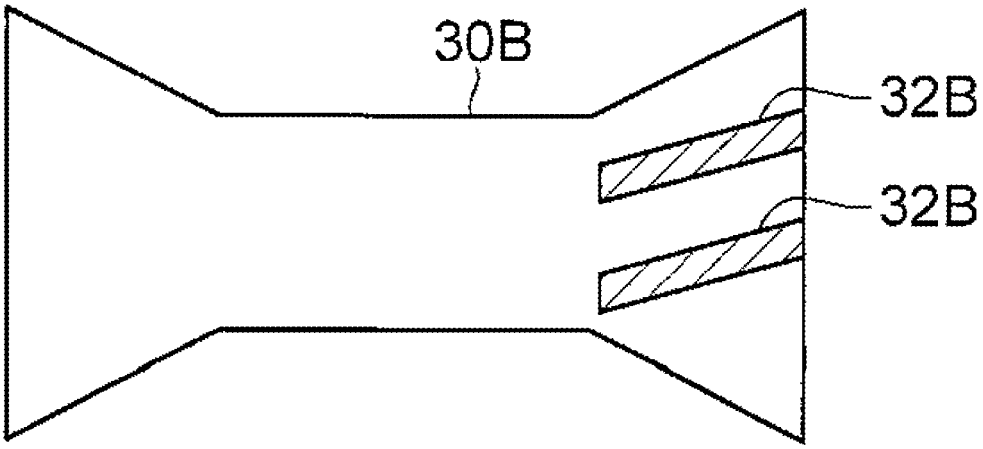
FIG. 8 is a transparent side view showing a configuration of a bass reflex port 30B, which is a third embodiment of the present invention.

FIG. 8 is a transparent side view showing a configuration of a bass reflex port 30B, which is a third embodiment of the present invention. The bass reflex port 30B of the present embodiment is attached to an acoustic device, similarly to the bass reflex port 30 of the first embodiment.

Both end portions of the bass reflex port 30B have flare shapes in which the surface areas of regions surrounded by the inner wall surface of the bass reflex port 30B expand toward the opening ends. The central portion of the bass reflex port 30B has a straight tube shape in which the area of the region surrounded by the inner wall surface of the bass reflex port 30B is kept approximately constant along the tube axis.

With the bass reflex port 30 of the first embodiment, the sheet-like members 30 were provided over the entire length along the tube axis. In contrast to this, the bass reflex port 30B of the present embodiment is provided with the sheet-like members 32B at portions in the circumferential direction of the inner wall surface in a segment that is a portion in the tube axis direction. Specifically, the sheet-like members 32B are provided at one end portion (the right-side end portion in FIG. 8) of the two end portions with the flare shape. The sheet-like members 32B are constituted by felt or the like, similar to the sheet-like members 32 of the first embodiment, and define regions with viscous resistances that are different from those of the other regions. The sheet-like members 32B are provided so as to draw a spiral along the tube axis from the boundary between the straight tube shape and the flare shapes to the opening end at one end portion. Since the sheet-like members 32B are provided from the boundary between the straight pipe shape and the flare shape to the opening end, in the bass reflex port 30B as well, the movement of the air in the tube axis direction is sufficiently hindered by the sheet-like members 32B.

In this manner, the bass reflex port 30B is similar to the bass reflex port 30 of the first embodiment in that the sheet-like members 32B forming the different viscous resistances are provided at portions in the circumferential direction of the inner wall surface of the bass reflex port 30B. For this reason, with the bass reflex port 30B, similarly to the bass reflex port 30, the positions and timings at which eddies occur differ in the circumferential direction due to the influence of the sheet-like members 32B. Accordingly, in the present embodiment as well, an effect similar to that of the first embodiment is obtained.

With the bass reflex port 30B of the present embodiment, the sheet-like members 32B were provided at only one end portion with the flare shape. However, the sheet-like members 32B need only be provided at portions in the circumferential direction of the inner wall surface in the bass reflex port 30B, and the sheet-like members 32B may be provided at both end portions with the flare shape, the sheet-like members 32B may be provided at only the central portion with the straight tube shape, the sheet-like members 32B may be provided at one end portion with the flare shape and the central portion with the straight tube shape, and the sheet-like members 32B may be provided at both end portions with the flare shape and the central portion with the straight tube shape.

With the bass reflex port 30B, the sheet-like members 32B were provided so as to draw a spiral along the tube axis. However, at one end portion with the flare shape of the bass reflex port 30B, the sheet-like members 32 may be provided so as to draw a simple radiating line shape toward the opening end.

Other Embodiments

Although first to third embodiments of the present invention have been described above, other embodiments are also conceivable for the present invention. Examples of other embodiments are as follows.

(1) Technical features of the embodiments may be combined as appropriate. For example, in the bass reflex port 30 of the first embodiment, multiple types of sheet-like members with different viscous resistances in the tube axis direction may be fixed alternatingly in the circumferential direction of the inner wall surface. Also, for example, with the bass reflex port 30A of the second embodiment, the regions in which the recessed portions 34A are provided, the regions in which the recessed portions 35A are provided, and the regions in which no recessed portions 34A or 35A are provided are arranged alternatingly in the circumferential direction.

Figure 9:
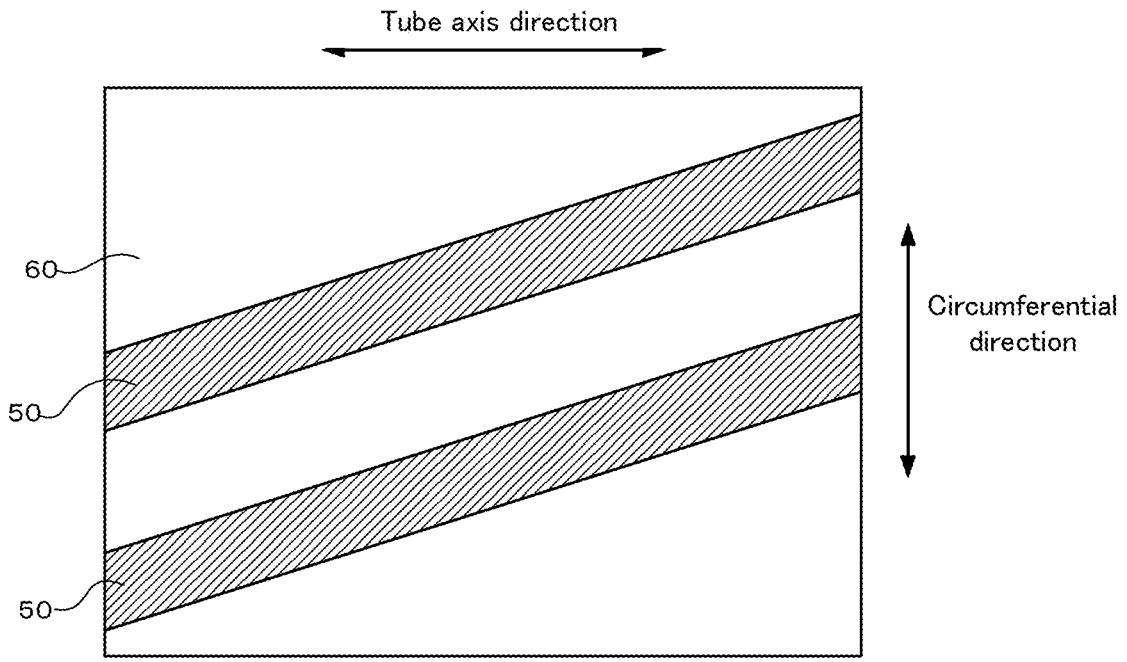
FIG. 9 is a development view showing another example of the inner wall surface of the bass reflex port according to the present invention.

(2) With the bass reflex port according to the present invention, the above-described regions with different viscous resistances may be arranged so as to be aligned in the circumferential direction at at least a portion in the tube axis direction of the inner wall surface of the tube body. Also, three or more regions with different viscous resistances may be provided in the circumferential direction. Accordingly, various modes are conceivable for the modes of the above-described regions in addition to the above-described embodiments. Hereinafter, FIGS. 9 to 12 are partial development views of the inner wall surface of the tube body. For example, as shown in FIG. 9, first regions 50 with a high viscous resistance and second regions 60 with a low viscous resistance are arranged so as to intersect with the tube axis direction X, that is, so as to extend obliquely on the inner wall surface (i.e., non-parallel with the tube axis direction X).

Figure 10:
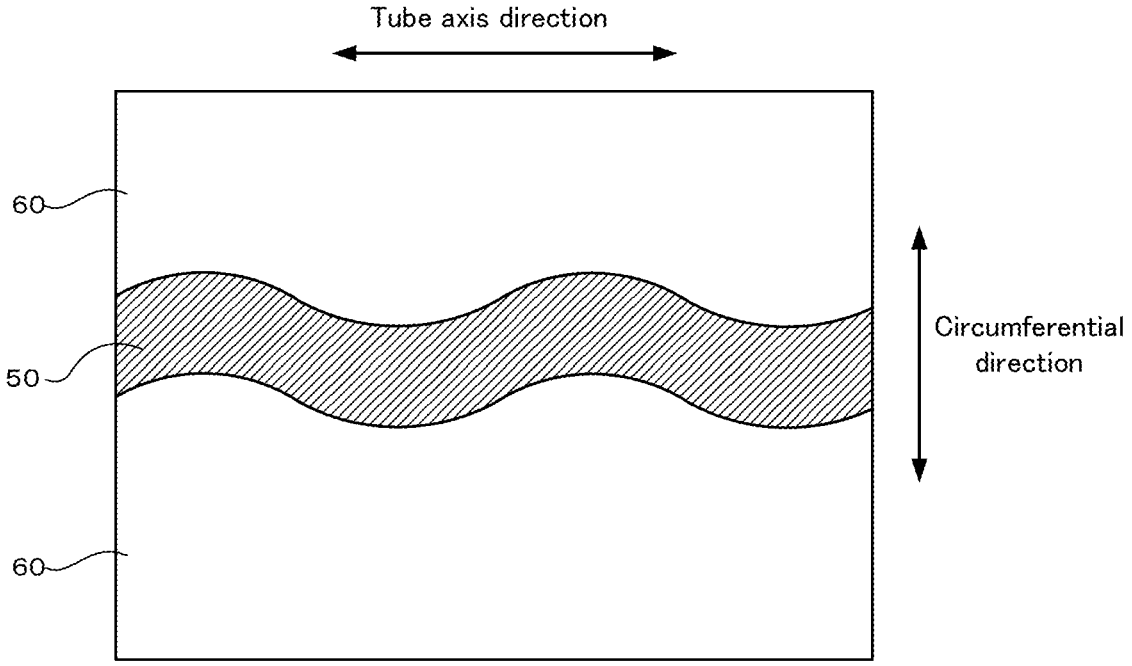
FIG. 10 is a development view showing another example of the inner wall surface of the bass reflex port according to the present invention.
Figure 11:
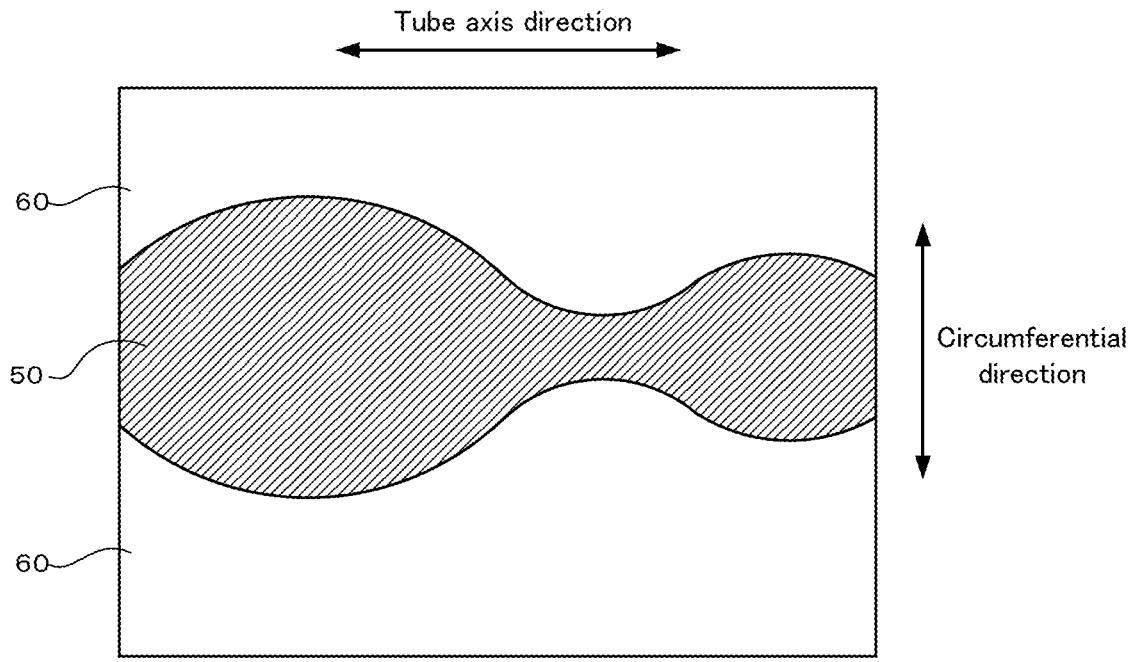
FIG. 11 is a development view showing another example of the inner wall surface of the bass reflex port according to the present invention.

Also, as shown in FIG. 10, the first region 50 with the high viscous resistance can also be arranged so as to extend in a wave shape along the tube axis direction. As shown in FIG. 11, the first region 50 can also be formed such that the width in the circumferential direction of the first region 50 changes along the tube axis direction. Thus, the shapes of the multiple regions are not particularly limited, and can be set not only to a rectangular shape as in the above-described embodiments, but also to various shapes such as polygonal shapes and circular shapes.

Figure 12:
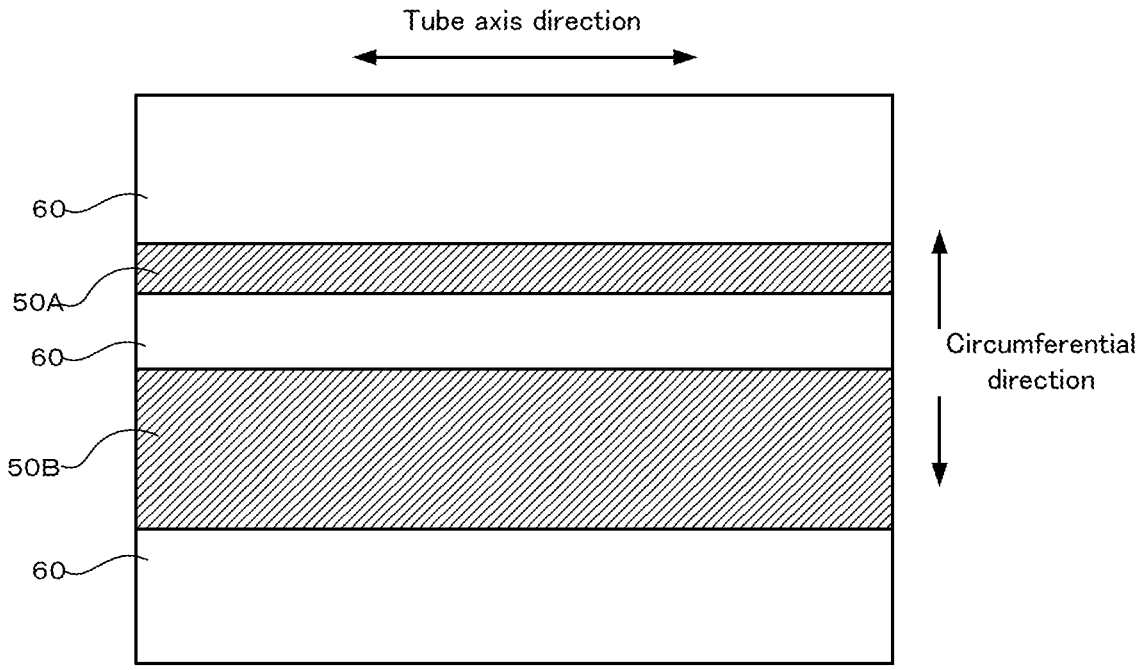
FIG. 12 is a development view showing another example of the inner wall surface of the bass reflex port according to the present invention.
Figure 13:
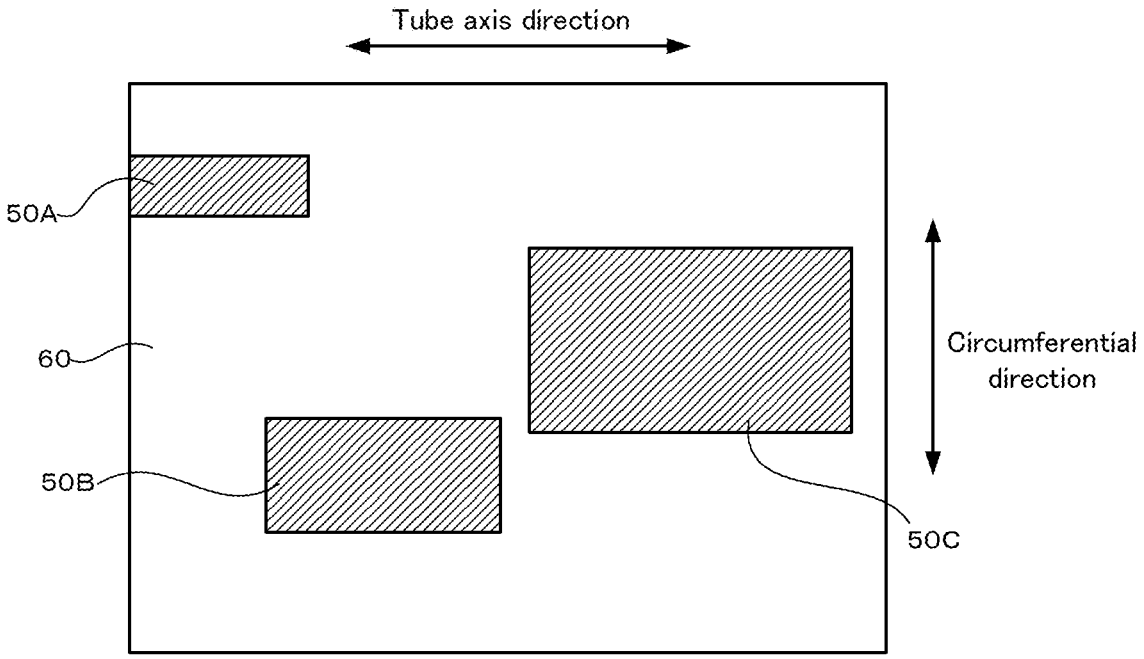
FIG. 13 is a development view showing another example of the inner wall surface of the bass reflex port according to the present invention.

Also, as shown in FIG. 12, in the case of providing multiple first regions 50A and 50B, it is also possible to provide multiple first regions with different widths in the circumferential direction. It is also possible to change the regions between the multiple first regions, that is, the widths in the circumferential direction of the second regions 60. Alternatively, as shown in FIG. 13, the multiple first regions can also be provided randomly in the tube axis direction and the circumferential direction. That is, first regions 50A, 50B, and 50C with respectively different lengths in the tube axis direction and lengths in the circumferential direction can also be provided randomly.

Figure 14:
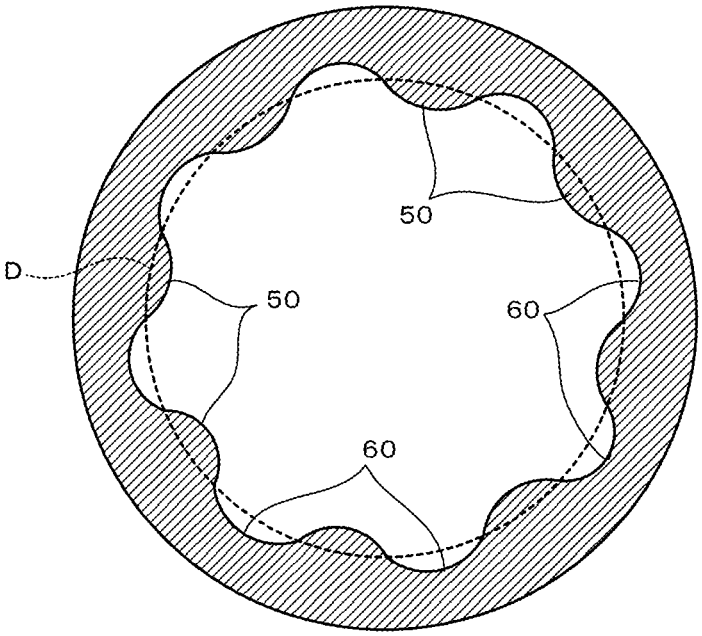
FIG. 14 is a cross-sectional view showing another example of the inner wall surface of the bass reflex port according to the present invention.

In the above-described example, the regions with different viscous resistances are provided in a dispersed manner in the circumferential direction. For example, although the viscous resistances change at the boundaries between the first regions and the second regions, the regions can also be formed such that the viscous resistances change gradually at the boundaries. For example, FIG. 14 shows a cross section of a tube body. This tube body is formed such that its thickness is not constant and the inner wall surface changes in a wave shape. More specifically, the portions that are thicker than a reference circle D are the first regions 50, and the portions that are thinner than the reference circle D are the second regions 60. Accordingly, the tube body can be formed such that the viscous resistances gradually change in the boundaries between the adjacent first regions 50 and second regions 60. Also, the tube body can be formed such that the viscous resistances gradually change within the regions 50 and 60 as well. Note that the shapes of the above-described regions can be combined and mixed as appropriate.

(3) In order to make the viscous resistances different in the regions, the material and shape of the inner wall surface of the tube body need only be changed, but it is also possible use a method other than that described above. That is, the viscous resistances can be made different by changing the material and shape of the inner wall surface, for example, the roughness of the inner wall surface of the tube body, the surface roughness (arithmetic average roughness, etc.), changing recesses and protrusions, and the like.

(4) The present invention may be provided to the market not only as an acoustic device of each embodiment, but also as an individual bass reflex port to be used in an acoustic device of each embodiment. This is because the acoustic device of each embodiment can be realized by attaching the bass reflex port to an acoustic device. Also, the acoustic device of each embodiment may be provided to the market mounted on a musical instrument such as an electronic keyboard instrument.

LIST OF REFERENCE NUMERALS

1 Acoustic device
10 Enclosure
12 Plate material
14 Opening
20 Speaker unit
30, 30A, 30B Bass reflex port
32, 32B Sheet-like member
34A, 35A Recessed portion

What is claimed is:

1. A bass reflex port for an acoustic device, the bass reflex port comprising:

a tubular body including at an inner wall surface thereof:

a first plurality of regions arranged spaced apart along a circumferential direction thereof and extending in an axial direction of the tubular body, from an entrance end of the tubular body to an exit end of the tubular body, each of the first plurality of regions providing a first air viscous resistance in the axial direction; and a second plurality of regions arranged spaced apart along the circumferential direction and extending in the axial direction, from the entrance end to the exit end, each of the second plurality of regions providing a second air viscous resistance, which is less than the first air viscous resistance, in the axial direction, wherein a flow rate of air passing over the first plurality of regions decreases toward the exit end at a greater rate than a flow rate of air passing over the third and fourth regions decreasing toward the exit end, so that positions and timings at which first eddies occurring due to air separating from the first plurality of regions and second eddies occurring due to air separating from the second plurality of regions differ in the circumferential direction.

2. The bass reflex port according to claim 1, wherein the first plurality of regions comprise materials providing different viscous resistances among the first plurality of regions.

3. The bass reflex port according to claim 1, wherein:

the first plurality of regions include at least a first region and a second region, and at least one of the first or second region include at least one of a recess or a protrusion.

4. The bass reflex port according to claim 3, wherein:

each of the first plurality of regions includes recesses or protrusions that provide the first air viscous resistance, and the size of the recesses or protrusions is different or the number of the recesses or protrusions arranged per unit area is different.

5. The bass reflex port according to claim 1, wherein:

the first plurality of regions include at least a first region and a second region, the second plurality of regions include at least a third region and a fourth region, and at least one of the first or second region and at least one of the third or fourth region extend non-parallel with the axial direction.

6. The bass reflex port according to claim 1, wherein:

the first plurality of regions include at least a first region and a second region, the second plurality of regions include at least a third region and a fourth region, and at least one of the first or second region and at least one of the third or fourth region extend along a wave shape in the axial direction.

7. The bass reflex port according to claim 1, wherein:

the first plurality of regions include at least a first region and a second region, the second plurality of regions include at least a third region and a fourth region, and widths in the circumferential direction of at least one of the first or second region and at least one of the third or fourth region change in the axial direction.

8. The bass reflex port according to claim 1, wherein widths of the first plurality of regions are different in the circumferential direction and widths of the second plurality of regions are different in the circumferential direction.

9. The bass reflex port according to claim 1, wherein:

the first plurality of regions include at least a first region and a second region, and widths in the circumferential direction of at least the first region and second region are different from each other.

10. The bass reflex port according to claim 1, wherein the first air viscous resistance of the first plurality of regions changes gradually at boundaries with the second plurality of regions.

11. The base reflect port according to claim 1, wherein:

the first plurality of regions include at least a first region and a second region, the second plurality of regions include at least a third region and a fourth region, air passing over the first and second regions and exiting the exit end is slower than air passing over the third and fourth regions and exiting the exit end so that a timing at which the first eddies occur is earlier than a timing at which the second eddies occur so that the first eddies occur at a position relatively nearer the exit end than the second eddies, while the second eddies occur at a position relatively nearer a center in the axial direction than the first eddies.

12. An acoustic device comprising:

an enclosure provided with an opening; and a bass reflex port arranged in the enclosure and comprising a tubular body, the tubular body being fixed to the enclosure at the opening, wherein the tubular body includes at an inner wall surface thereof:

a first plurality of regions arranged spaced apart along a circumferential direction thereof and extending in an axial direction of the tubular body, from an entrance end of the tubular body to an exit end of the tubular body, each of the first plurality of regions providing a first air viscous resistance in the axial direction; and a second plurality of regions arranged spaced apart along the circumferential direction and extending in the axial direction, from the entrance end to the exit end, each of the second plurality of regions providing a second air viscous resistance, which is less than the first air viscous resistance, in the axial direction, wherein a flow rate of air passing over the first plurality of regions decreases toward the exit end at a greater rate than a flow rate of air passing over the third and fourth regions decreasing toward the exit end, so that positions and timings at which first eddies occurring due to air separating from the first plurality of regions and second eddies occurring due to air separating from the second plurality of regions differ in the circumferential direction.

13. The acoustic device according to claim 12, wherein:

the first plurality of regions include at least a first region and a second region, the second plurality of regions include at least a third region and a fourth region, and at least one of the first or second region and at least one of the third or fourth region extend non-parallel with the axial direction.

14. The acoustic device according to claim 12, wherein:

the first plurality of regions include at least a first region and a second region, the second plurality of regions include at least a third region and a fourth region, and at least one of the first or second region and at least one of the third or fourth region extend along a wave shape in the axial direction.

15. The acoustic device according to claim 12, wherein:

the first plurality of regions include at least a first region and a second region, the second plurality of regions include at least a third region and a fourth region, and widths in the circumferential direction of at least one of the first or second region and at least one of the third or fourth region change in the axial direction.

16. The acoustic device according to claim 12, wherein widths of the first plurality of regions are different in the circumferential direction and widths of the second plurality of regions are different in the circumferential direction.

17. The acoustic device according to claim 12, wherein:

the first plurality of regions include at least a first region and a second region, and widths in the circumferential direction of at least the first region and second region are different from each other.

18. The acoustic device according to claim 12, wherein the first air viscous resistance of the first plurality of regions changes gradually at boundaries with the second plurality of regions.

19. The acoustic device according to claim 12, wherein:

the first plurality of regions include at least a first region and a second region, the second plurality of regions include at least a third region and a fourth region, and air passing over the first and second regions and exiting the exit end is slower than air passing over the third and fourth regions and exiting the exit end so that a timing at which the first eddies occur is earlier than a timing at which the second eddies occur so that the first eddies occur at a position relatively nearer the exit end than the second eddies, while the second eddies occur at a position relatively nearer a center in the axial direction than the first eddies.

20. The acoustic device according to claim 12, wherein one of the entrance end or the exit end of the tubular body is fixed to the enclosure at the opening.

* * * * *